US006744897B1

(12) United States Patent
Vonlanthen

(10) Patent No.: US 6,744,897 B1
(45) Date of Patent: Jun. 1, 2004

(54) HEARING AID

(75) Inventor: André Vonlanthen, Remetschwil (CH)

(73) Assignee: Phonak AG, Stafa (CH)

( * ) Notice: Subject to any disclaimer, the term of this patent is extended or adjusted under 35 U.S.C. 154(b) by 0 days.

(21) Appl. No.: 09/448,362

(22) Filed: Nov. 23, 1999

(30) Foreign Application Priority Data

Nov. 8, 1999 (WO) ..... PCT/CH99/00524

(51) Int. Cl.[7] ..... H04R 25/00
(52) U.S. Cl. ..... 381/322; 381/324; 381/328
(58) Field of Search ..... 381/322, 324, 381/327, 328, 330, 380, 381, 382; 181/129, 130, 135

(56) References Cited

U.S. PATENT DOCUMENTS

| | | | | |
|---|---|---|---|---|
| 3,368,644 A | * | 2/1968 | Henderson | 381/327 |
| 4,800,982 A | * | 1/1989 | Carlson | 381/328 |
| 4,867,267 A | * | 9/1989 | Carlson | 381/328 |
| 5,535,282 A | * | 7/1996 | Luca | 381/328 |
| 5,832,094 A | * | 11/1998 | Le Her | 181/130 |

FOREIGN PATENT DOCUMENTS

| | | |
|---|---|---|
| DE | 40 10 372 A1 | 10/1991 |
| DE | 43 27 634 C1 | 6/1994 |
| EP | 0 377 074 A2 | 7/1990 |
| WO | WO 91/03139 | 3/1997 |

* cited by examiner

*Primary Examiner*—Huyen Le
(74) *Attorney, Agent, or Firm*—Pearne & Gordon LLP

(57) ABSTRACT

A hearing aid having a receiver connected to a microphone, the receiver having a one hole, a second hole, a first tubular canal and a second tubular canal, provided in such a way that acoustic signals produced in the receiver are transmitted by the first tubular canal from one hole into the ear canal of the hearing aid wearer. The second tubular canal has a first end and a second end, with the first end directly connected to the outside world when the hearing aid is in use and the second end is directly connected to the second hole in the receiver, for allowing communication from the first end to the second end. The dimensions or shape of one or both tubular canals can be chosen such that reflections of acoustic signals can be avoided.

11 Claims, 1 Drawing Sheet

HEARING AID

FIELD OF THE INVENTION

This invention concerns the hearing aid in the preamble to Patent claim 1.

Hearing aids are used to equalize or compensate for hearing problems in a patient by processing acoustic signals picked up with a microphone that go through a receiver in the patient's ear canal and are amplified or changed. An acoustic outlet hole is provided on the hearing aid through which the acoustic signals produced by the receiver are fed into the auditory canal.

BACKGROUND OF THE INVENTION

It has long been known that the acoustic outlet hole is often reduced in size or even stopped up completely with deposits, so-called earwax. Moreover, these deposits spread out further into the inside of the hearing aid, and get into the inside of the receiver or the hole. The result of this is that the transmission properties of the hearing aid change. In addition, irreparable damage often occurs to the individual components of the hearing aid, and especially to the receiver itself.

A hearing aid is known from EP-0 377 074-A2 that has a receiver with two holes, where a first tubular canal leads from a hole in the receiver into the patient's ear canal and a second tubular canal from the second hole in the receiver to the side of the hearing aid pointing to the outside—the so-called face plate. The inside of the hearing aid has a chamber connecting the two holes, which is bounded on one side by a moving membrane, and the membrane can be deflected by a regulating unit to produce acoustic signals. Besides the chamber mentioned, there are two other chambers and holes in the housing of the hearing aid, through which a pressure difference produced by changes in height can be equalized between the ear canal and the atmosphere on the hearing aid. Such pressure-equalization devices are also called "pressure vent" devices.

According to the known theory, deposits that have settled over time, especially in the receiver or in the canal to the ear canal of the hearing-aid wearer, can be removed from the receiver and thus from the hearing aid by opening the hole in the face plate, which is closed during operation and by pushing a cleaning agent through the second canal, the receiver and finally the first canal with a spray or the like. In this way, all deposits can be flushed out. After the cleaning process, the hole in the face plate is closed again so that—according to the known publication—no unacceptable changes in transmission function can occur.

SUMMARY OF THE INVENTION

The problem of the invention is to specify a hearing aid that has a much simpler design compared to the known hearing aids, but is no in any way inferior to the known hearing aids in terms of function.

This problem is solved by the measures given in the characterizing part of Patent Claim 1. Advantageous variations of the invention are given in the other claims.

The invention has the following advantages: because a receiver with two-holes is used in the hearing aid, one hole of which is connected via a canal to the ear canal of the hearing-aid wearer and the other hole via another canal to the outside world, the hearing aid can be cleaned in the simplest way, for example by blowing it out. At the same time, the canals also serve as a pressure vent, with no unacceptable change in the characteristic transmission function. The hearing aid in the invention also has the advantage that choosing the dimensions of the other canal can improve the transmission properties of the first canal in terms of conduction adjustment to avoid reflections.

The invention will be explained in greater detail below using the drawings as examples.

DETAILED DESCRIPTION OF THE PREFERRED EMBODIMENTS

Figure 1:
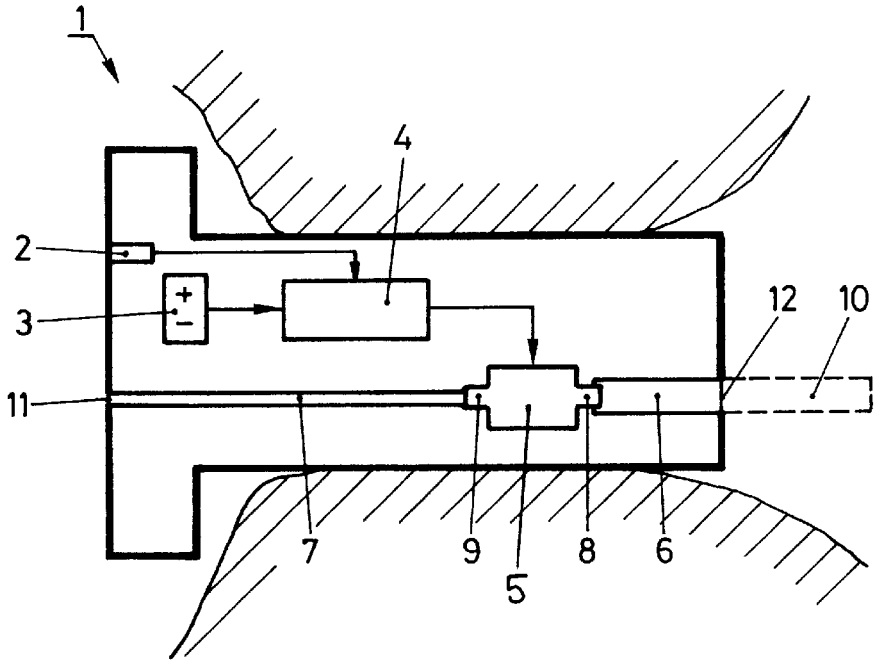
FIG. 1 shows a schematic view of the hearing aid in the invention used in an ear and FIG. 2 shows different frequency paths of hearing aids according to the invention.

FIG. 1 shows the hearing aid 1 in the invention, which consists of a microphone, a signal-processing unit 4, an energy-storage unit 3 and a receiver 5, which has two holes 8 and 9. The hearing aid 1 shown is a so-called ITE (in the ear) hearing aid, i.e., the hearing aid is inserted into the outer ear canal of the hearing aid wearer. The following statements therefore also apply to BTE (behind the ear) hearing aids in terms of meaning. Where this is not the case, it will be specifically stated below.

According to the usual way in which hearing aids work, in the hearing aid 1 in the invention, acoustic signals from the environment are converted with the microphone into electrical signals 2 which the signal-processing unit 4 processes. Based on how the hearing of the hearing aid wearer is affected, which is detemined beforehand, the signal is treated in the signal-processing unit 4, i.e. amplified. The electrical output signal from the signal-processing unit 4 is acted on by the receiver 5 in the order in which the electrical signals are converted into acoustic signals, which finally go through a hole 8, a tubular canal 6 and a first output 12 into the ear canal of the hearing aid wearer.

Next to hole 8, the receiver 5 has a second hole 9 which is connected to the outside world via a tubular canal 7 and via a second output 11. Since one preferred embodiment has a connection going through between the two outputs 11 and 12, the dimensions and the shape of the two canals 6 and 7 must be chosen in such a way that the acoustic signals produced in the receiver 5 are mainly transmitted in the direction of the ear canal of the hearing aid wearer. The connection between the ear canal and the outside world containing the receiver 5 makes it possible to blow out, i.e. clean the components carrying the acoustic signal in the simplest way. Moreover, this connection between the ear canal and the outside world has a compensating effect on pressure when the hearing aid is used, i.e., like the pressure vent device mentioned and known in and of itself, but not in this form.

To clean the hearing aid components carrying the acoustic signals, i.e., receiver 5 and canals 6 and 7, there is air or a cleaning agent, for example with the help of a spray, to push through the hearing aid components, to blow out all kinds of impurities in them, i.e., to remove them from it.

Thus the original transmission characteristics are in turn produced in which the hearing aid performs the desired function in the best possible way.

The other canal 7 in the invention is also used to compensate for all kinds of reflections that are obtained because the conduction is not adjusted, i.e., because of the canal 7 and other factors influencing the transmission (like the shape of the ear canal, for example). When the conduction is not adjusted in this way, there is resonance in the receiver 5, and thus in the knickpoint in the frequency path of the receiver, proceeding to higher frequencies. Thus undamped receivers and those with simpler designs can be used in the hearing aid in the invention.

In connection with the use of undamped receivers, it has been shown that a length of 24 mm is especially advantageous for the tubular canal 7. Of course, a person skilled in the art of conduction adjustment will make corresponding changes in the length and not follow this specification under all circumstances.

With behind-the-ear hearing aids, the acoustic signals do not go into the ear canal at output 12, but there must be another element, often termed a hook element which takes the acoustic signal into the ear canal of the hearing aid wearer. FIG. 1 shows such a hook element and refers to it by number 10. Because of the changed transmission properties compared to the in-the-ear hearing aid, the second canal 7 must be adjusted, i.e., in the sense of the explanations made in connection with conduction adjustment.

Figure 2:
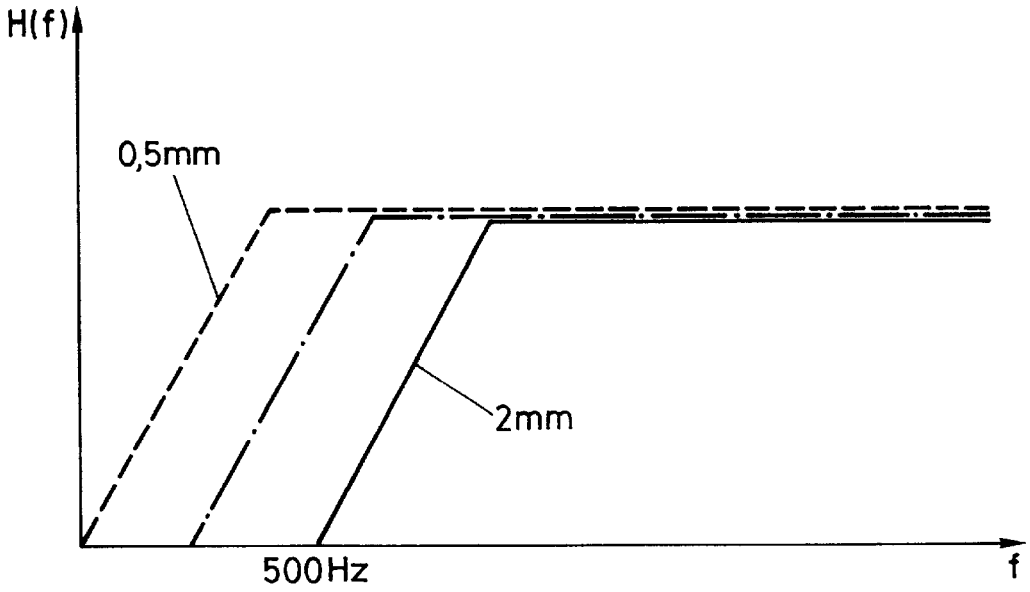

FIG. 2 shows a simplified view of three frequency paths of the hearing aid 1 in the low-frequency range, where the corresponding hearing aids differ in that their tubular canals 7 have different diameters. Thus, the frequency path of one hearing aid 1 in which a canal 7 with a diameter of 2 mm is used is shown with a solid line. In between a variation is shown in which a diameter between 0.5 and 2 mm is chosen for canal 7. Although the diameter chosen for canal 7 is preferably in the specified range, the choice is in no way limited by these data. Limitations are caused rather by the physical circumstances, like for example threatened feedback by acoustic signals produced by the receiver 5 back into the microphone 2.

The hearing aids in the invention also have the advantages mentioned when canals 6 and 7 are not tubular. Rather it is conceivable to provide any kind of means in such a way that—in the case of canal 6—acoustic signals produced in the receiver 5 are transmitted from the one hole 8 of the receiver into the ear canal of the hearing aid wearer and—in the case of canal 7—a connection is made by the second hole 9 of the receiver 5 to the outside world. Thus, according to the invention, another connection between the ear canal and the outside world is dispensed with, which makes it possible for the design to be simpler than the known hearing aids.

What is claimed is:

1. A hearing aid, including a microphone (2), a signal-processing unit (4), a receiver (5) with two holes (8, 9) and an energy-storage unit (3), which supplies one or more of the signal-processing unit (4), the microphone (2), and the receiver (5) with energy, where the microphone (2) is connected to the signal-processing unit (4), and it is connected to the receiver (5), and where first means (6, 12, 10) are provided in such a way that acoustic signals produced in the receiver (5) are transmitted from the one hole (8) into the ear canal of the hearing aid wearer, characterized by the fact that other means (7, 11) are provided in such a way that the second hole (9) in the receiver (5) is directly connected to the outside world via the other means when the one hole is in communication with the ear canal of the hearing aid wearer, wherein the dimensions or shape of the other means are chosen such that reflections of acoustic signals can be avoided.

2. The hearing aid in claim 1, characterized by the fact that a direct connection from the outside world into the ear canal of the hearing aid wearer is provided via other means (11, 6), the receiver (5) and the first means (7, 12, 10).

3. The hearing aid in claim 1 or 2, characterized by the fact that the dimensions or shape of the other means (11, 6) are chosen in such a way that reflections of acoustic signals can be avoided.

4. The hearing aid in claim 1 characterized by the fact that the first means (7, 10, 12) with the help of which acoustic signals are transmitted into the ear canal and/or the other means (6, 11) for connecting the second hole (9) in the receiver (5) are connected to the outside world via tubular canals.

5. The hearing aid in claim 4, characterized by the fact that the other means (11, 6) made by means of the tubular canal have a diameter from 0.5 mm to 2.0 mm.

6. The hearing aid in claim 4 or 5, characterized by the fact that the length of the means (11, 6) made by means of the tubular canals is 24 mm.

7. The hearing aid in claim 1 or 2, characterized by the fact that on an end of the first means (6) next to the ear canal, a hook element (10) is connected which has a hollow space for carrying acoustic signals.

8. The use of the hearing aid in one of claims 1, 2 or 4 as a BTE (behind the ear) hearing aid.

9. A hearing aid, including a microphone (2), a signal-processing unit (4), a receiver (5) with two holes (8, 9) and an energy-storage unit (3), which supplies one or more of the signal-processing unit (4), the microphone (2), and the receiver (5) with energy, where the microphone (2) is connected to the signal-processing unit (4), and it is connected to the receiver (5), and where first means (7, 12, 10) are provided in such a way that acoustic signals produced in the receiver (5) are transmitted from the one hole (8) into the ear canal of the hearing aid wearer, characterized by the fact that other means (6, 11) are provided in such a way that the second hole (9) in the receiver (5) is directly connected to the outside world via the other means when the hearing aid is in use, wherein the dimensions or shape of the other means are chosen such that reflections of acoustic signals can be avoided.

10. A hearing aid comprising:

a microphone;

a signal-processing unit connected to the microphone;

a receiver connected to the microphone, the receiver having a one hole and a second hole;

a battery for providing power to one or more of the signal processing unit, the microphone, and the receiver;

a first tubular canal provided in such a way that acoustic signals produced in the receiver are transmitted by the first tubular canal from the one hole into the ear canal of the hearing aid wearer, and a second tubular canal having a first end and a second end, wherein the first end is directly connected to the outside world when the hearing aid is in use and wherein the second end is directly connected to the second hole in the receiver, for allowing communication from the first end to the second end.

11. The hearing aid of claim 10, wherein the dimensions or shape of the second tubular canal are chosen such that acoustic signals produced in the receiver are mainly transmitted in the direction of the ear canal.

* * * * *

UNITED STATES PATENT AND TRADEMARK OFFICE

CERTIFICATE OF CORRECTION

PATENT NO. : 6,744,897 B2
DATED : June 1, 2004
INVENTOR(S) : André Vonlanthen

It is certified that error appears in the above-identified patent and that said Letters Patent is hereby corrected as shown below:

Column 3,
Line 51, please delete "which supplies one or more of the", and insert therefor -- which supplies the --.
Line 52, please delete "unit (4), the microphone (2), and the receiver (5) with energy,", and insert therefor -- unit (4), with energy --.

Column 4,
Line 28, please delete "which supplies one or more of the", and insert therefor -- which supplies the --.
Line 29, please delete "unit (4), the microphone (2), and the receiver (5) with energy,", and insert therefor -- unit (4), with energy --.

Signed and Sealed this

Nineteenth Day of October, 2004

JON W. DUDAS
*Director of the United States Patent and Trademark Office*